United States Patent [19]

Simmons

[11] 4,134,506

[45] Jan. 16, 1979

[54] MATERIAL HANDLING MEANS FOR USE IN EARTHWORKING MACHINES

[75] Inventor: Gerald P. Simmons, Washington, Ill.

[73] Assignee: Caterpillar Tractor Co., Peoria, Ill.

[21] Appl. No.: 859,365

[22] Filed: Dec. 13, 1977

[51] Int. Cl.[2] ..... E02F 3/81

[52] U.S. Cl. ..... 214/140; 214/145 R

[58] Field of Search ..... 214/140, 145 R, 769, 214/773, 775

[56] References Cited

U.S. PATENT DOCUMENTS

| | | | |
|---|---|---|---|
| 2,835,397 | 5/1958 | Wagner | 214/140 X |
| 2,978,124 | 4/1961 | Bernotas | 214/774 X |
| 3,240,371 | 3/1966 | Conrad | 214/140 |
| 3,369,680 | 2/1968 | Peterson | 214/145 R |
| 3,845,870 | 11/1974 | Balderson et al. | 214/145 R |

*Primary Examiner*—L. J. Paperner

*Attorney, Agent, or Firm*—Wegner, Stellman, McCord, Wiles & Wood

[57] ABSTRACT

An earthworking machine having a frame and wheels carried by the frame for movement of the machine over subjacent terrain. A bucket is provided having a rear portion defining rearwardly opening recesses. The recesses are arranged to accommodate reception of the tilt and lift arms of the material handling structure. The recesses may further be arranged to accommodate a portion of the front wheels of the machine in preselected dispositions of the material handling structure. The material handling structure is arranged to be rocked on a rounded rear portion thereof while resting on the subjacent terrain so as to provide an improved freeing of the material being removed prior to the lifting thereof in the bucket. The material handling structure is arranged to provide a low profile providing improved unobstructed viewing forwardly from the machine in normal use.

10 Claims, 3 Drawing Figures

MATERIAL HANDLING MEANS FOR USE IN EARTHWORKING MACHINES

BACKGROUND OF THE INVENTION

1. Field of the Invention

This invention relates to earthworking machines and in particular to material handling means for use therein.

2. Description of the Prior Art

In U.S. Pat. No. 708,587 of Arthur W. Robinson, a dredge bucket is shown having rearwardly projecting connecting portions for connection thereto of lifting and control structure.

In U.S. Pat. No. 2,180,348 of Arthur W. Daniels, a dipper is shown having a plurality of rearwardly extending flanges to which the support means is connected.

Eddie B. Wagner, in U.S. Pat. No. 2,835,397, shows a loader wherein the bucket rests on the ground in a loading position and wherein the bucket includes inwardly extending portions in the front wall for receiving front portions of the bucket supporting structure. The bucket also includes a central inwardly extending portion extending upwardly from the bottom of the bucket and from front to rear thereof for receiving a hydraulic cylinder for tipping the bucket.

Ralph J. Bernotas, in U.S. Pat. No. 2,978,124, shows a cradle loader having narrow vertical housings projecting into the bowl of the bucket for receiving cylinder elements of the tilt jacks.

SUMMARY OF THE INVENTION

The present invention comprehends an improved earthworking machine having a bucket including a rear portion defining a plurality of rearwardly opening recesses to receive at least a substantial portion of the arm means of the connecting linkage to the bucket in a retracted disposition of the bucket in the machine. The bucket further defines recesses arranged to receive a portion of the front wheels of the machine in the retracted disposition of the bucket. Still further, the bucket is arranged to receive a lesser portion of the front wheels in the loading disposition of the bucket to effectively minimize the forward extension of the bucket in normal use.

The rear portion of the bucket defining the recesses is rounded so as to permit a rocking of the bucket from the loading position to the rack-back position for facilitated breaking free of the material being handled by the machine. The recessed disposition of the control arms permits the rocking of the bucket free of interference between the arms and the subjacent terrain.

The bucket rear wall is arranged to receive both the tilt arm and lift arm means of the connecting linkage in the illustrated embodiment.

Thus, the earthworking machine structure of the present invention is extremely simple and economical of construction while yet providing the highly improved low profile facilitated rocking bucket functioning discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
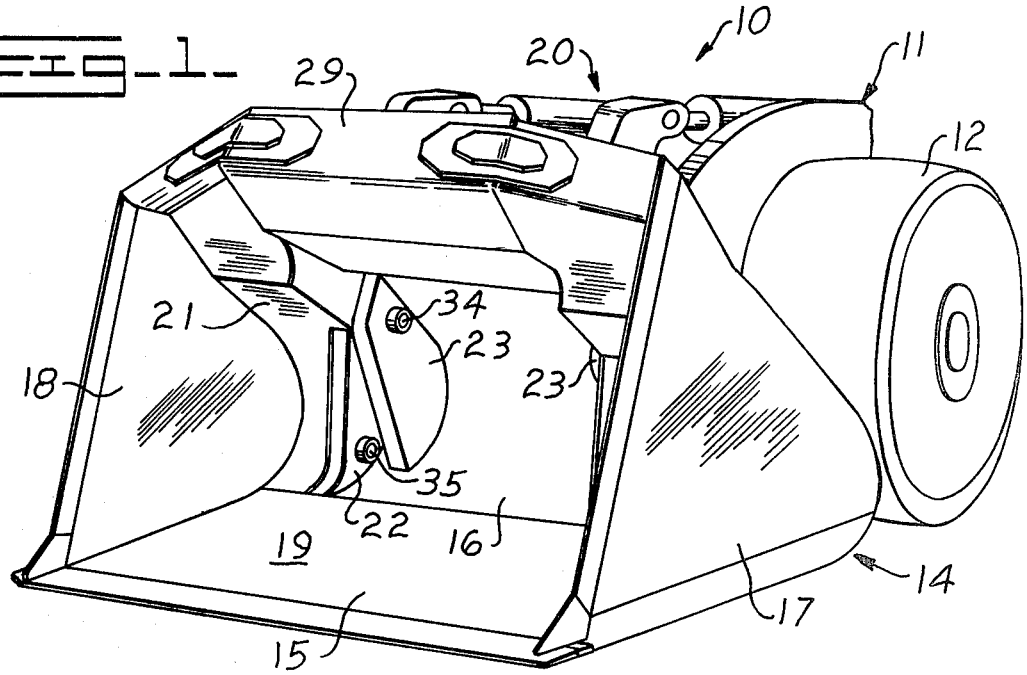
FIG. 1 is a fragmentary perspective view of an earthworking machine embodying the invention.

In the exemplary embodiment of the invention as disclosed in the drawing, an earthworking machine generally designated 10 is fragmentarily shown to comprise a wheeled vehicle 11 having a pair of front wheels 12 at opposite sides of a frame 13 of the vehicle.

A bucket generally designated 14, illustratively comprising a loader bucket having a front wall 15, a rear wall 16, left sidewall 17 and right sidewall 18 defining a loading space 19 is mounted to the frame 13 by a connecting linkage generally designated 20. The invention comprehends a novel cooperative association of the bucket and connecting linkage to provide a low profile machine, as illustrated in FIG. 1 of the drawing, wherein the bucket is disposed in effectively nested relationship with the front portion of the vehicle 11 in the loading disposition so as to provide a compact, easily handled arrangement. The low profile arrangement further permits for improved viewability by the operator of the machine providing for improved efficiency in the use of the machine. Still further, the nested arrangement permits application of substantial earthmoving forces with minimum machine tipping tendencies.

More specifically as shown in the drawing, the rear wall 16 is provided with three pairs of rearwardly opening recess portions, namely, recess portions 21, 22 and 23. Recess portion 21 is disposed at opposite sides of the rear wall 16 and defines recesses 24 for receiving a portion of the front wheels 12 and providing the rearwardly nested arrangement of the bucket relative to vehicle 11. Recess portions 22 define rearwardly opening recesses 25 for receiving portions of the lift arms 26 of the connecting linkage 20. Recess portions 23 define rearwardly opening recesses 27 for receiving portions of the tilt arms 28 of the connecting linkage 20. As shown in the drawing, recess portions 22 are disposed inwardly of recess portions 21 and recess portions 23 are disposed adjacently inwardly of recess portions 22 at the opposite sides of the bucket.

Figure 2:
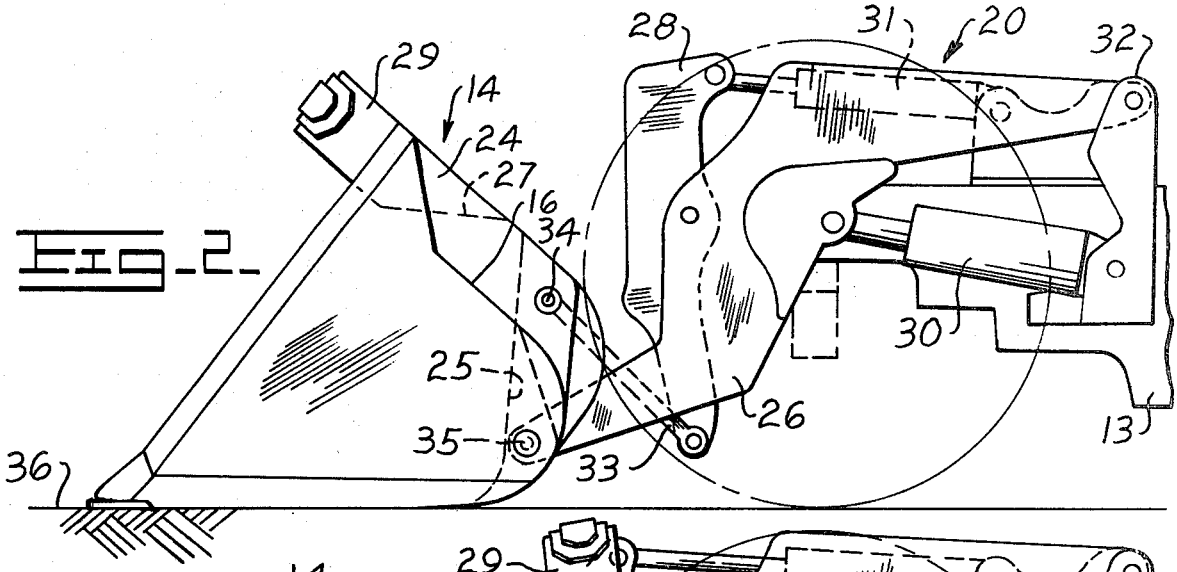
FIG. 2 is a fragmentary side elevation of the bucket and connecting means.
Figure 3:
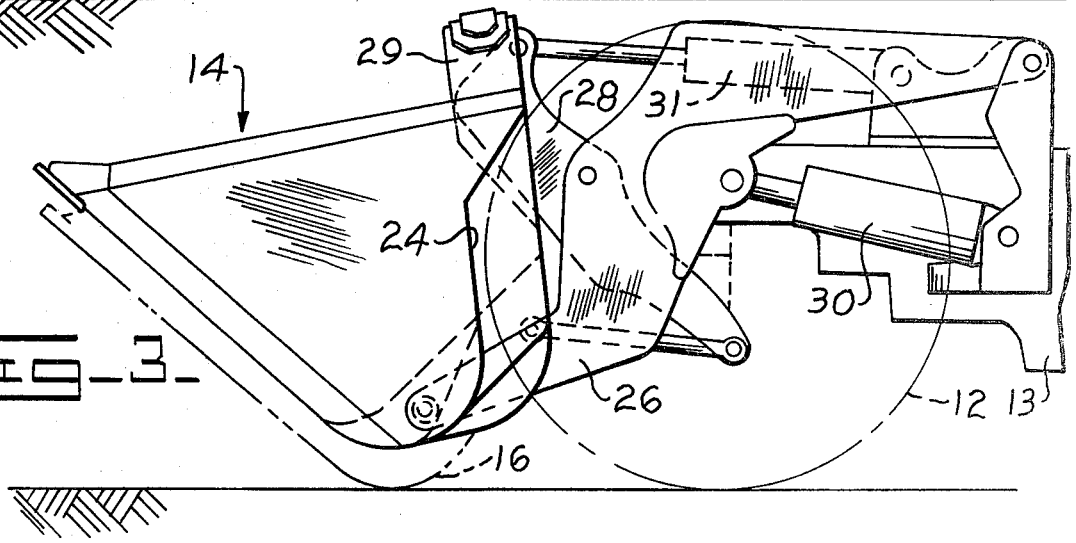
FIG. 3 is a fragmentary side elevation illustrating the arrangement of the bucket and connecting means in a rackback position in broken lines and a lifted position in full lines.

As more specifically illustrated in the drawing, the bucket includes a transverse beam portion 29 at the upper end of the rear wall 16 which provides improved corner loading of the bucket to effectively prevent collapsing of the bucket in rigorous use. As shown in FIGS. 2 and 3, the tilt arm recess 24 extends upwardly into the beam portion 29 of the bucket. As shown, the recess 24 terminates at the upper end of the rear wall 16 subjacent the beam portion 29.

The connecting linkage 20 may further include the conventional lift cylinders 30 and tilt cylinders 31 which may be suitably pivotally linked between the arms 26 and 28, respectively, and in tower assembly 32, mounted to the frame 13. Tilt arm 28 may include a distal link portion 33 pivotally connected to the bucket by means of a pivot means 34 on recess portion 23, and arm 26 may be connected to the bucket by a pivot means 35 on recess portion 22.

In the loading position of FIGS. 1 and 2, the front wall 15 rests in substantial facial engagement with the subjacent terrain surface 36. To facilitate lifting of the collected load in the bucket space 19, the bucket is arranged to be rocked about the rounded rear wall 16 by the connecting linkage so as to provide a lever action in releasing the collected material for subsequent lifting thereof by the earthworking machine. Thus, the linkage rocks the bucket from the loading position of FIG. 2 to the rack-back position shown in broken lines in FIG. 3 about the rounded rear wall 16 so as to provide the highly desirable rocking-type leverage action. During such rocking movement, the recesses 24 accommodate reception of a greater portion of the vehicle wheels until, as shown in FIG. 3 in the elevated arrangement of the bucket, the wheels are effectively extended to substantially fully nested within the recesses 24. As shown in FIG. 2, a small portion of the wheels may be received within the recesses 24 in the loading position, if desired. It is to be understood that the bucket can also be used in a conventional manner wherein the bucket is fulcrumed about the front axle.

As further shown in FIGS. 2 and 3, the upper portion of the tilt arms 28 are received within the beam portion 29 of the bucket when the bucket is in the rack-back position and elevated position of FIG. 3.

The provision of the recess portions of the bucket in only the rear wall 16 thereof provides for effectively maximizing the available face within the bucket for material loading purposes while yet permitting the bucket to be disposed with effectively minimum forward projection from the vehicle portion of the machine. Thus, a large capacity loading operation may be effected with minimum tipping tendencies, thereby providing highly improved safety in the use of the earthworking machine in such relatively dangerous fields, such as mining and the like. The low profile provides further advantage in such mining operations in permitting minimizing of the height of the area being mined to accommodate the machine.

As discussed above, the rocking-type action utilizing a lever or fulcrum principle in freeing the earth being removed by the machine provides substantially increased force availability for further facilitated earthworking efficiency. The rocking action effectively minimizes tipping tendencies in the earth removing operations further providing improved safety in the use of the machine.

The foregoing disclosure of specific embodiments is illustrative of the broad inventive concepts comprehended by the invention.

The embodiments of the invention in which an exclusive property or privilege is claimed are defined as follows:

1. In an earthworking machine having a frame, and wheels carried by the frame for permitting movement of the machine on subjacent terrain, said wheels including a pair of front wheels at opposite sides of a front portion of the frame, improved material handling means comprising:

a bucket having a front wall and a rear wall defining a plurality of rearwardly opening recesses, said rear wall having a lower portion of substantially constant curvature across the entire width of the bucket; and arm means movably connecting the bucket to the vehicle frame, said recesses and arm means being cooperatively arranged to permit said recesses to have at least a substantial portion of said arm means received therein in a retracted disposition of the bucket in the machine, at least a portion of said recesses being arranged to receive a portion of said front wheels in said retracted disposition of the bucket, said rear wall lower portion being rockable on the subjacent ground between a forwardly opening loading position and said retracted position.

2. The earthworking machine structure of claim 1 wherein said bucket defines a front wall and said bucket rear portion defines a rear wall having a forwardly projecting portion defining said rearwardly opening recess rearwardly of said front wall.

3. The earthworking machine structure of claim 1 wherein said arm means includes a pair of lift arms spaced transversely of the frame and said bucket rear portion defines a pair of said rearwardly opening recesses aligned with and adapted to receive one each said spaced lift arms.

4. The earthworking machine structure of claim 1 wherein said arms means includes a pair of lift arms spaced transversely of the frame, and a pair of tilt arms spaced transversely of the frame, and said bucket rear portion defines at least two pairs of said recesses aligned with and adapted to receive one each said spaced lift and tilt arms.

5. The earthworking machine structure of claim 1 wherein said bucket rear portion defines pivot journals at the sides of said recesses for pivotal connection of the arm means to the bucket in the recess.

6. The earthworking machine structure of claim 1 wherein said recesses open horizontally in a loading position of the bucket whenever the bucket opens forwardly horizontally and are disposed to open downwardly in said retracted disposition of the bucket wherein said bucket rear wall rests on the subjacent terrain.

7. The earthworking machine structure of claim 1 wherein said recesses open horizontally in the loading position of the bucket and are disposed to open downwardly in said retracted disposition of the bucket wherein said bucket rear wall rests on the subjacent terrain, said recesses further opening rearwardly horizontally in said retracted disposition.

8. The earthworking machine structure of claim 1 wherein said bucket rear portion defines a pair of side recesses receiving said portion of the vehicle front wheels in said retracted disposition.

9. The earthworking machine structure of claim 1 wherein said bucket rear portion defines a pair of side recesses receiving said portion of the vehicle front wheels in said retracted disposition, and said recesses receive a substantially lesser portion of the vehicle front wheels in the loading position wherein the front wall rests on the subjacent terrain.

10. The earthworking machine structure of claim 1 wherein said bucket further includes a transverse beam portion at an upper end of said rear portion defining a portion of said recesses receiving said arm means.

* * * * *